US006561961B2

(12) United States Patent
Wu

(10) Patent No.: US 6,561,961 B2
(45) Date of Patent: May 13, 2003

(54) ADJUSTING MECHANISM FOR A SEAT BACK OF EXERCISER

(75) Inventor: Mu-Chuan Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 69 days.

(21) Appl. No.: 09/969,666

(22) Filed: Oct. 4, 2001

(65) Prior Publication Data

US 2003/0069113 A1 Apr. 10, 2003

(51) Int. Cl.[7] ..... A63B 71/00

(52) U.S. Cl. ..... 482/148; 482/908; 482/142; 297/363; 297/367

(58) Field of Search ..... 482/57, 908, 51, 482/58, 59, 142; 297/353, 354.1, 361.1, 362.11, 362.14, 363, 364, 367

(56) References Cited

U.S. PATENT DOCUMENTS 6,139,104 A * 10/2000 Brewer ..... 297/353
6,168,553 B1 1/2001 Kuo ..... 482/57
6,193,314 B1 * 2/2001 Chiang ..... 297/301.7
6,260,923 B1 * 7/2001 Yamada et al. ..... 297/366
6,267,443 B1 * 7/2001 Kurita et al. ..... 297/374
6,296,306 B1 * 10/2001 Specht et al. ..... 297/216.14
6,302,482 B1 * 10/2001 Moll et al. ..... 297/340
6,419,318 B1 * 7/2002 Albright ..... 297/284.7
6,511,129 B1 * 1/2003 Minor et al. ..... 397/367

* cited by examiner

*Primary Examiner*—Nicholas D. Lucchesi
*Assistant Examiner*—Lori Baker Amerson
(74) *Attorney, Agent, or Firm*—Bacon & Thomas, PLLC

(57) ABSTRACT

An adjusting mechanism for a seat back of an exerciser includes a pressure rod provided behind a seat back frame. The pressure rod has a cylinder, with its top surface pivotally connected to the seat back frame and a cylinder piston rod having a pressure-leaking valve provided at a lower end to leak out pressure in the cylinder and activate the cylinder piston rod to extend and shrink. A control rod base is fixed behind the seat back frame, having a housing for receiving the cylinder shaft. A control rod is fitted with the control rod base, with its horizontal end contacting with the pressure-leaking valve and its vertical rod positioned beside the seat frame. When the vertical rod is swung up, the pressure-leaking valve leak out the pressure in the cylinder and the cylinder piston rod activate the seat back frame to move backward to any angle.

3 Claims, 6 Drawing Sheets

ADJUSTING MECHANISM FOR A SEAT BACK OF EXERCISER

BACKGROUND OF THE INVENTION

This invention relates to an adjusting mechanism for a seat back of an exerciser, particularly to one simple in structure, quick in assembling, convenient in handling, and capable to meet a user's requirements in adjusting the seat back to any comfortable position.

A conventional adjusting mechanism for a seat back of an exerciser, as disclosed in a U.S. Pat. No. 6,168,553, is to have a sector tooth block provided under a main rod behind the seat back and a housing provided near a rear end of a fundamental base. The housing is pivotally provided with a control shaft fitted stably with a sleeve having a coronary tooth block and a wing member fixed on its solid portion. The control shaft is rotated to make the coronary tooth block engaged with or disengaged from the sector tooth block of the seat back so as to get a slanting angle of the seat back a user wants However, the conventional adjusting mechanism mentioned above has the following defects.

1. It is inconvenient to assemble such an adjusting mechanism due to its complicated components.

2. An angle needed is adjusted mainly by engaging two tooth blocks together. Specifically, the control shaft is actuated to let one of the two tooth blocks move partially toward one side of the other tooth block and then make two tooth blocks engage each other after an angle needed is adjusted. But, in case the teeth of two tooth blocks are not exactly engaged together, it is most likely to result in irritating noises.

3. The angle adjusted is restricted by the width between every two teeth on the tooth block and every stage of adjustment is limited generally between 5–10 degrees, having no function of adjusting an angle to a most comfortable position.

SUMMARY OF THE INVENTION

This invention has been devised to offer an adjusting mechanism for a seat back of an exerciser, simple in structure, quick in assembling and possible to be adjusted to any position that is most comfortable for a user.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
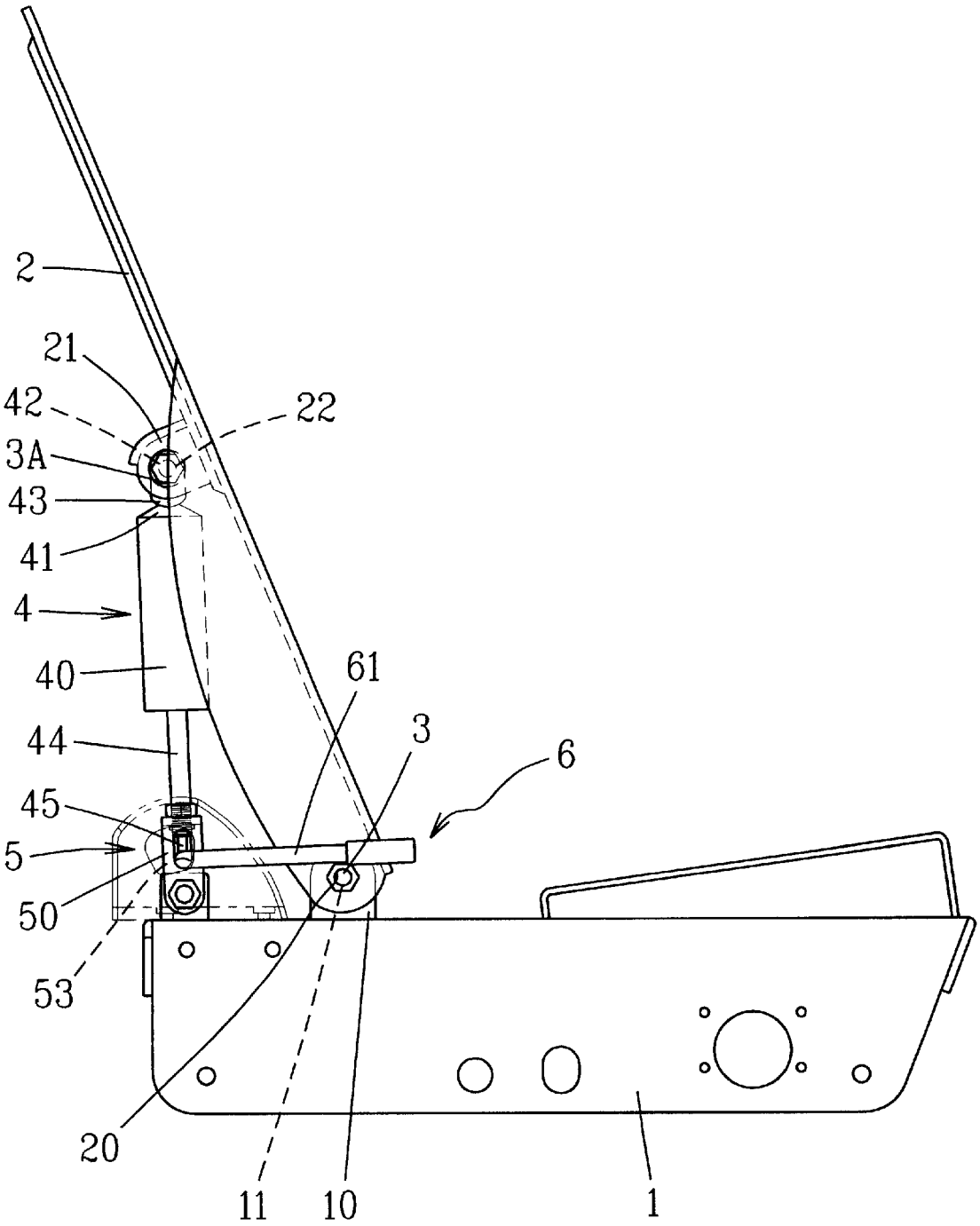
FIG. 1 is a side cross-sectional view of an adjusting mechanism for a seat back of an exerciser in the present invention.
Figure 2:
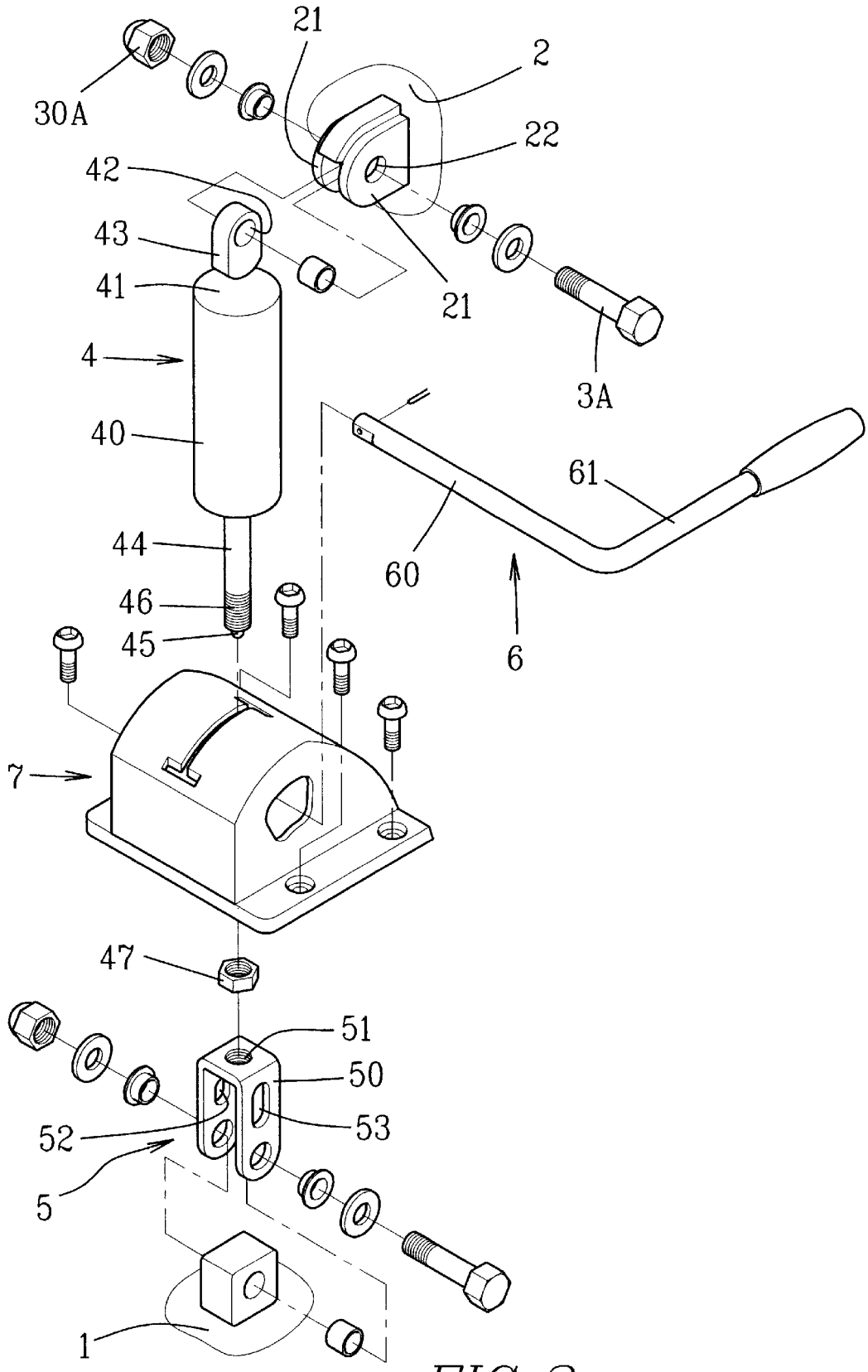
FIG. 2 is an exploded perspective view of the adjusting mechanism for a seat back of an exerciser in the present invention.

A preferred embodiment of an adjusting mechanism for a seat back of an exerciser, as shown in FIGS. 1 and 2, includes a seat frame a seat back frame 2, a pressure rod 4, a control rod base 5, and a control rod 6 as main components combined together.

The seat frame 1 has a seat provided on top and two vertical projections 10 respectively formed on a left and a right side of a rear portion, having pivotal holes 11 facing each other.

Figure 3:
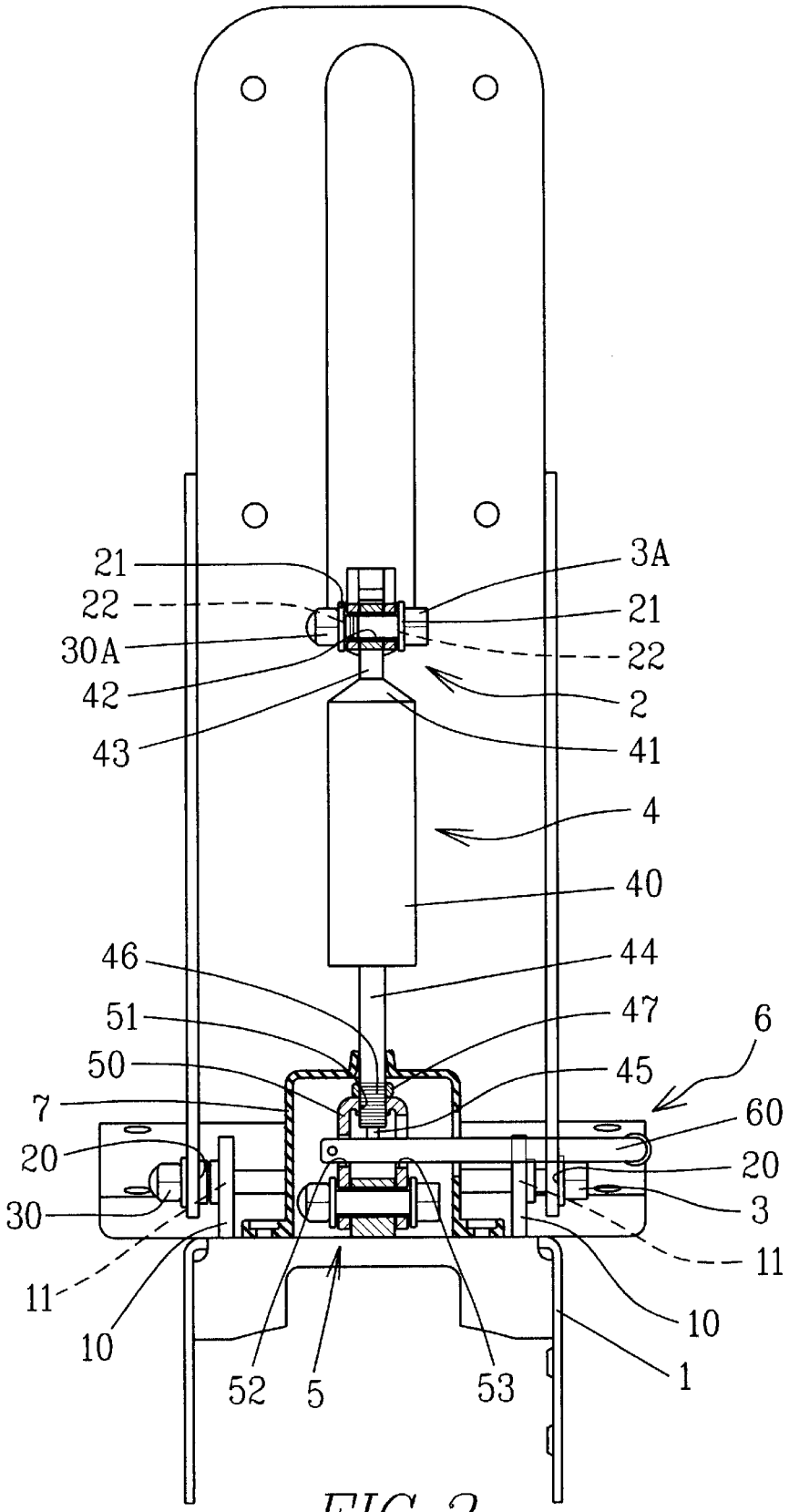
FIG. 3 is a rear cross-sectional view of the adjusting mechanism for a seat back of an exerciser in the present invention.
Figure 4:
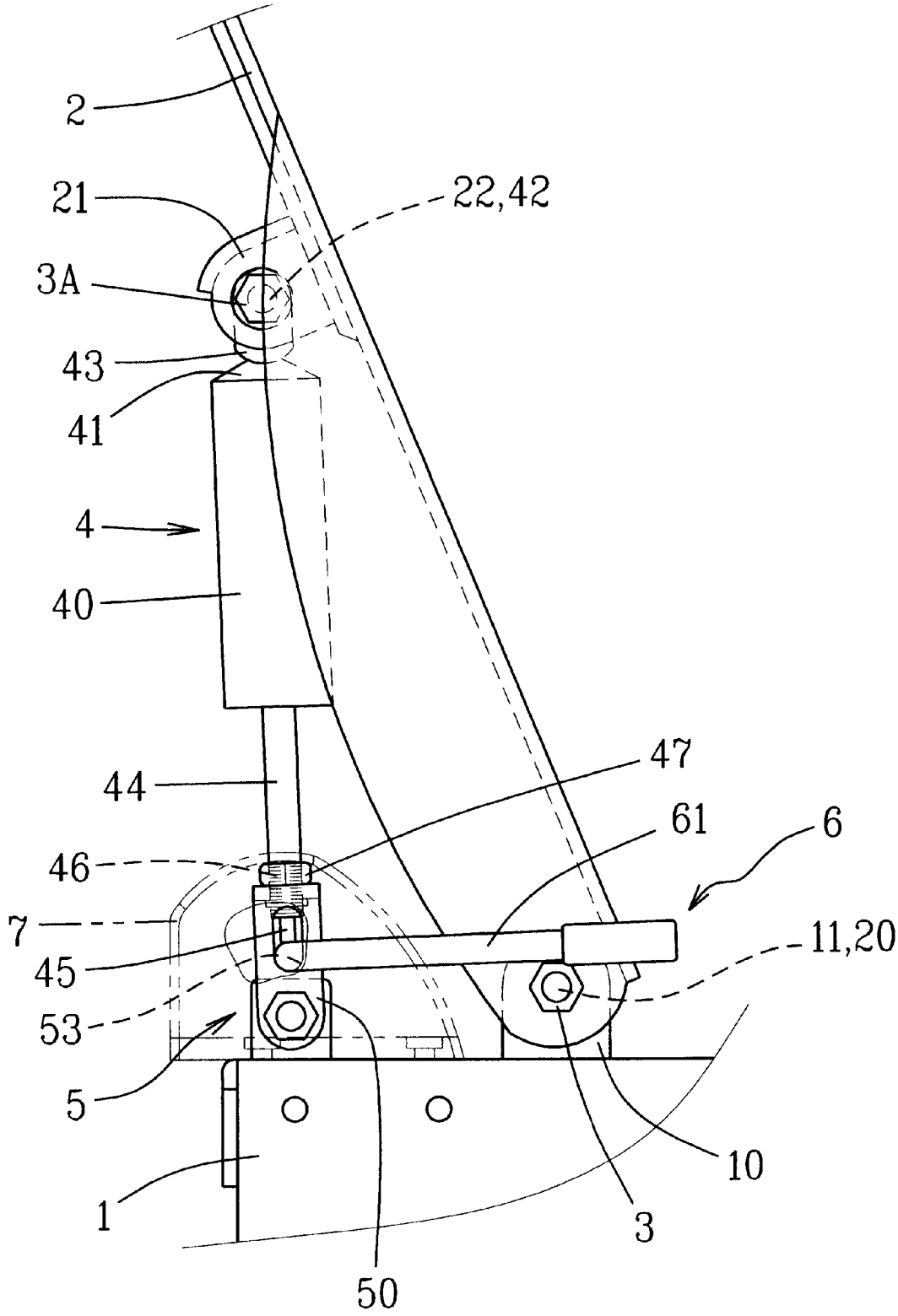
FIG. 4 is a side cross-sectional view of the adjusting mechanism for a seat back of an exerciser in the present invention.

The seat back frame 2 has two pivotal holes 20 bored at opposite sides of a bottom portion to correspond to the pivotal holes 11 of the seat frame 1. The seat frame 1 and the seat back frame 2 are pivotally combined together by means of a threaded rod 3 passing through the pivotal holes 1 of the seat frame 1 and the pivotal holes 20 of the seat back frame 2 and then screwed in place with a nut 30, as shown in FIG. 3. Thus, the seat back frame 2 is vertically positioned on a rear upper portion of the seat frame 1 and can be adjusted backward to any position.

The pressure rod 4, referring to FIGS. 1, 2, 3 and 4, is positioned behind the seat back frame 2, having a cylinder 40. The cylinder 40 has a closed top surface 41 with a vertical projection 43 extending up thereon and having a through pivotal hole 42, and a cylinder piston rod 44 inserted in a lower end. The cylinder piston rod 44 is fitted on a lower end with a pressure-leaking valve 45 capable to be compressed to leak out the pressure inside the cylinder 40 and force the cylinder piston rod 44 to extend out of the cylinder 40. Further, the seat back frame 2 has a pair of pivotal plates 21 with lateral pivotal holes 22 fixed on a rear upper side to match with the projection 43 of the cylinder 40, as shown in FIG. 2. The projection 43 of the cylinder 40 is inserted between two pivotal plates 21 of the seat back frame 2 to make the top end of the pressure rod 4 pivotally connected to the rear side of the seat back frame 2 by means of a bolt 3A passing through the pivotal holes 22 of the pivotal plates 21 and the pivotal hole 42 of the projection 43 and then screwed with a nut 30A.

The control rod base 5, as shown in FIGS. 2 and 3, is positioned behind the seat back frame 2 and formed as an inverted U-shaped housing 50 pivotally fixed on the seat frame 1 behind the seat back frame 2.

The housing 50 has a female threaded hole 51 on top for the cylinder piston rod 44 of the pressure rod 4 to insert therein. Besides, the cylinder piston rod 44 has its lower end formed with a male threaded surface 46 to be screwed with a nut 47 in advance so that after inserted into the opening 51 of the housing 50, the cylinder shaft 44 and restricted by the nut 47, the cylinder piston rod 44 will be positioned on the housing 50, as shown in FIG. 1. In addition, the inverted U-shaped housing 50 has two vertical slots 52 and 53 of different sizes bored on opposite sides.

The control rod 6 is L-shaped, with its horizontal end 60 inserted in the housing 50 through a relatively large slot 53, protruding out of the slot 52 and then pivotally screwed there as a fulcrum, and with its vertical rod 61 extending out beside the seat frame 1 to be swung up manually. Additionally, the horizontal portion 60 has its end contacting with the bottom side of the pressure-leaking valve 45 within the control rod base 5. Thus, with the edge of the small slot 52 serving as a fulcrum and through the long vertical slot 53 of the control rod base 5, the control rod 6 can easily be swung upward to activate the cylinder shaft 44 to move in the pressure rod 4, as shown in FIG. 3.

Figure 5:
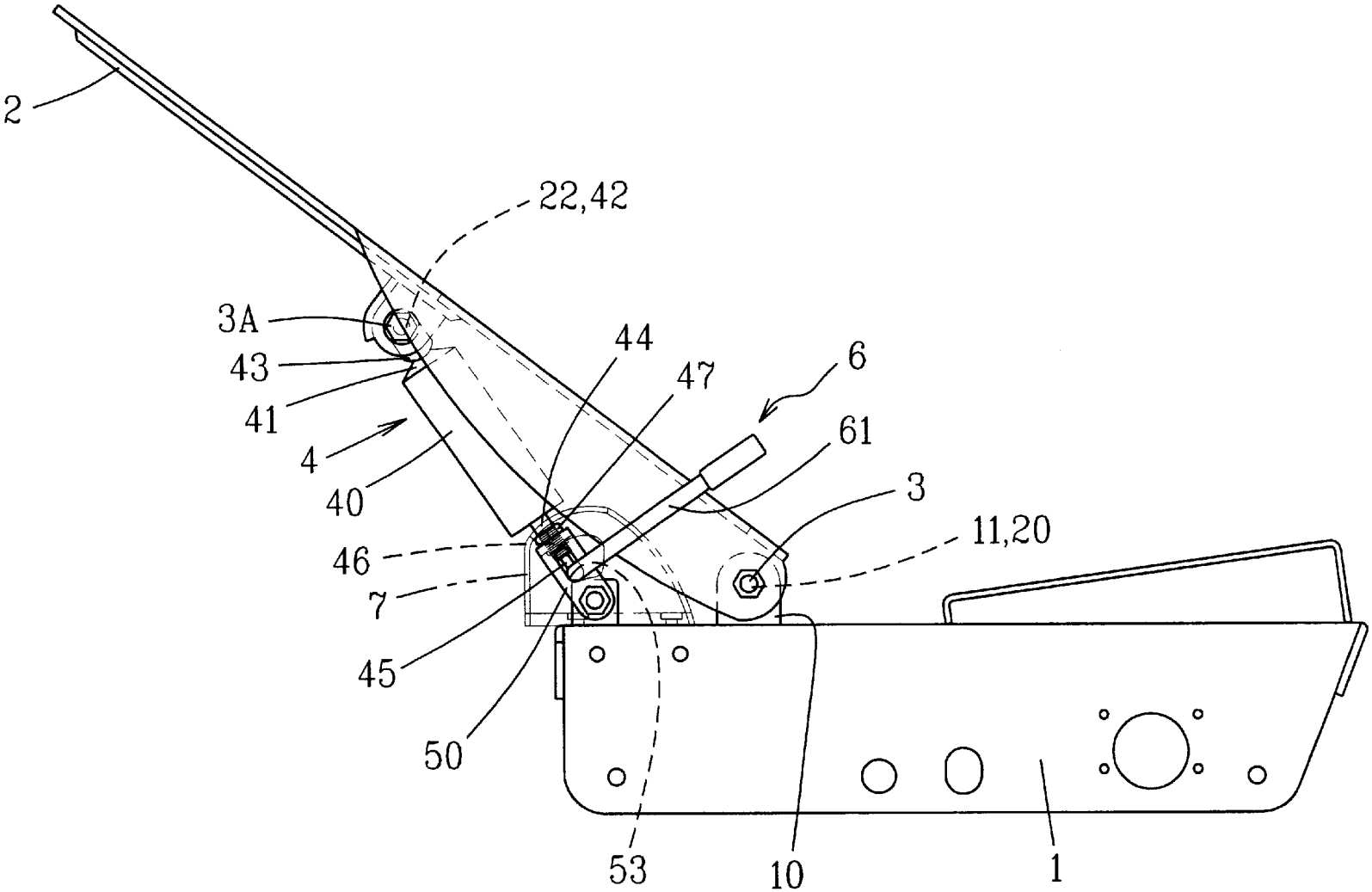
FIG. 5 is a side cross-sectional view of the adjusting mechanism for a seat back of an exerciser, with the seat back adjusted backward to a certain angle in the present invention.
Figure 6:
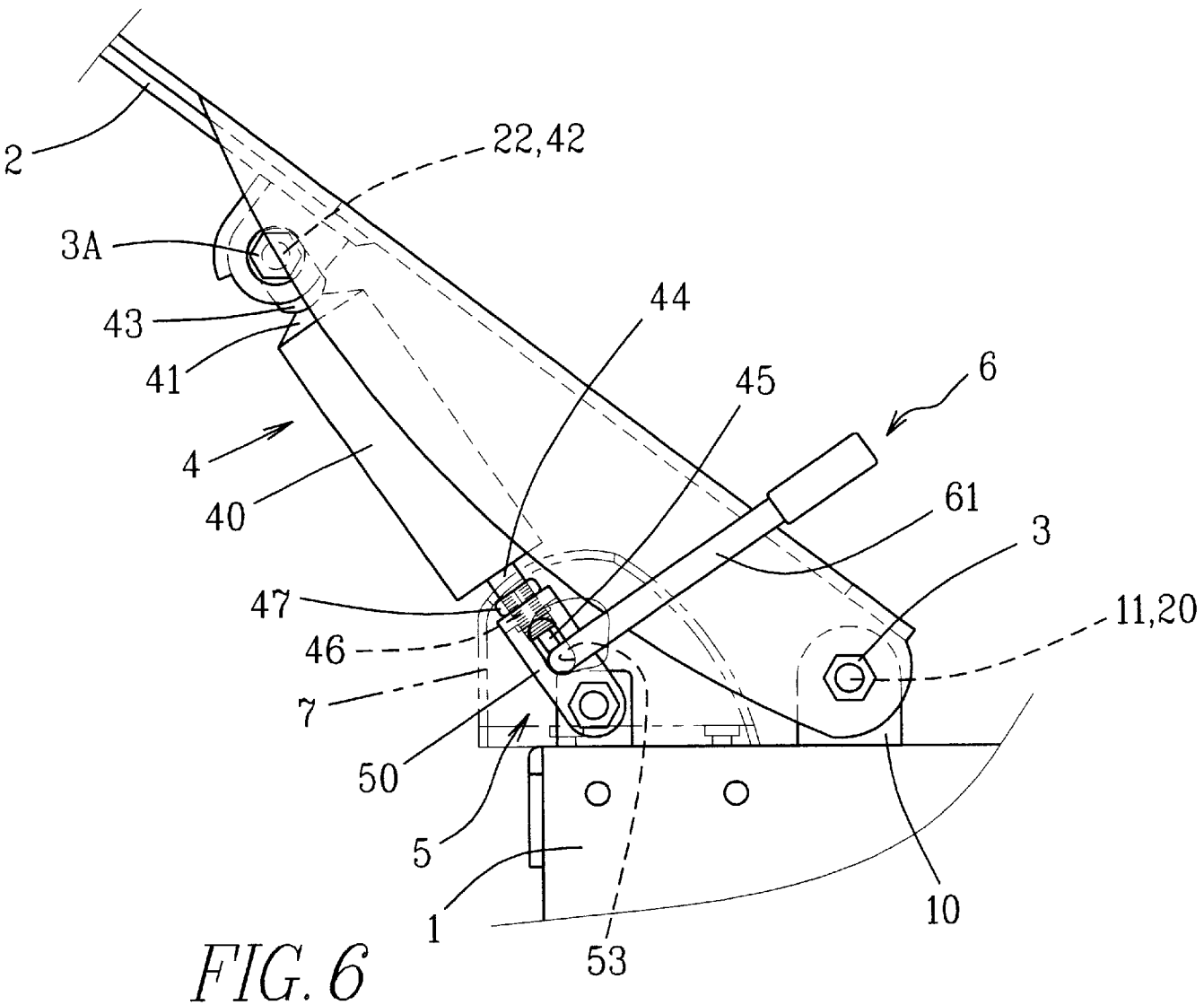
FIG. 6 is a partially magnified view of FIG. 5.

To adjust the seat back frame 2 backward to a certain angle, a user sitting on the seat frame 1 and having his/her back leaning on the seat back frame 2, only swings up a bit the control rod 6 beside the seat frame 1 to compress the pressure-leaking valve 45 of the cylinder shaft 44 to leak out the pressure inside the cylinder 40 so as to let the cylinder shaft 44 capable to extend and shrink therein. At this time, when the user has his/her back lean against the seat back frame 2, the seat back frame 2 will slant backward, as shown in FIGS. 5 and 6, and after a suitable angle of the seat back frame 2 is acquired, release the control rod 6 immediately and the seat back frame 2 will firmly maintain the slanting angle just set, thus obtaining a function of adjusting the seat back frame 2 backward to any angle most comfortable for a user. On the contrary, if a next user wants the seat back frame 2 to be adjusted to a comparatively high position, just manually swing up the control rod 6 and the seat back frame 2 will be pushed to a relatively high position by the pressure rod 4, needless to lean a user's back on the seat back frame 2.

To sum up, the adjusting mechanism for a seat back of an exerciser in this invention is more convenient in adjusting an angle of the seat back frame, simpler in assembling and more economical in required components than those of the conventional one.

Furthermore, a safe protective cover 7 of soft material can be provided between the control rod 6 and the control rod base 5, as shown in FIGS. 2 and 3, to guard against external ashes, mosquitoes or the like and prevent a person's hand from stretching in, having functions of protection and safety.

While the preferred embodiment of the invention has been described above, it will be recognized and understood that various modifications may be made therein and the appended claims are intended to cover all such modifications that may fall within the spirit and scope of the invention.

I claim:

1. An adjusting mechanism for a seat back of an exerciser comprising:

a seat frame having a seat provided on top;

a seat back frame having two opposite bottom sides pivotally connected with two opposite top sides of a rear portion of said seat frame;

a pressure rod provided behind said seat back frame and having a cylinder, said cylinder having a closed top surface, said closed top surface having a projection extending up thereon to be pivotally connected to a proper position of said seat back frame, said cylinder having a cylinder piston rod extending out from a lower side, a pressure-leaking valve provided on a lower end of said cylinder piston rod to be compressed to leak out the pressure inside said cylinder and activate said cylinder piston rod to extend and shrink in said cylinder;

a control rod base fixed behind said seat back frame, having a housing pivotally fixed on said seat frame behind said seat back frame, said housing having an hole on top for said cylinder piston rod of said pressure rod to extend in and be positioned, said pressure-leaking valve of said pressure rod positioned within said control rod base, said housing of said control rod base having two slots of different sizes respectively bored on opposite sides, with one of them shaped longer;

a control rod having one end inserted into said control rod base via said long-shaped slot, protruding out of another slot and then pivotally positioned to serve as a fulcrum there, said control rod having the other end positioned vertically beside said control rod base for a user to control to adjust said seat back frame, with the top end of said control rod contacting with the bottom end of said pressure-leaking valve in said control rod base;

said control rod swung up to compress said pressure-leaking valve of said pressure rod to let said cylinder piston rod extend and shrink and synchronously activate said seat back frame to move backward and forward, having a function of adjusting said seat back frame to any possible angle.

2. The adjusting mechanism for a seat back of an exerciser as claimed in claim 1, wherein said control rod is L-shaped.

3. The adjusting mechanism for a seat back of an exerciser as claimed in claim 1, where in a safety protective cover of soft material is provided between said control rod and said control rod base.

* * * * *